United States Patent [19]

Callon et al.

[11] Patent Number: 5,058,393

[45] Date of Patent: Oct. 22, 1991

[54] DISPLAY APPARATUS FOR INDIRECTLY REFRIGERATING FOOD AND BEVERAGE ITEMS

[75] Inventors: Floyd R. Callon, Punta Gorda, Fla.; Harvey W. Benison, Cincinnati, Ohio

[73] Assignee: Dyment Limited, Toronto, Canada

[21] Appl. No.: 507,140

[22] Filed: Feb. 22, 1990

[51] Int. Cl.[5] ..... A47F 3/04

[52] U.S. Cl. ..... 62/255; 62/251

[58] Field of Search ..... 62/255, 251–253, 62/246; 312/116

[56] References Cited

U.S. PATENT DOCUMENTS

| | | | |
|---|---|---|---|
| 678,612 | 7/1901 | Daemicke | 62/246 |
| 1,462,285 | 7/1923 | Hilger | 312/116 X |
| 2,030,780 | 2/1938 | Bicknell | 312/116 X |
| 2,207,472 | 7/1940 | Young | 312/116 |
| 3,306,068 | 2/1967 | Allgeyer et al. | 62/255 X |
| 3,366,432 | 1/1968 | Carmer | 62/255 X |
| 3,769,805 | 11/1973 | Corini | 62/255 X |
| 4,831,841 | 5/1989 | Falk | 62/255 X |

FOREIGN PATENT DOCUMENTS

| | | | |
|---|---|---|---|
| 198288 | 6/1958 | Austria | 62/255 |

*Primary Examiner*—William E. Tapolcai

*Attorney, Agent, or Firm*—Wood, Herron & Evans

[57] ABSTRACT

A portable, refrigerated article display apparatus for indirectly refrigerating individually packaged articles, such as food items and/or beverages, and promoting impulse buying comprises a base, a hollow housing having a transparent, outer cylindrical-shaped wall and an article support assembly mounted in the interior of the housing atop a rotatable article support carriage. The article support assembly comprises either a shelf unit having a series of interlocking, vertically stacked shelf members adapted to support food items such as prepared sandwiches, a beverage rack having a plurality of vertically extending columns adapted to support beverage containers stacked end-to-end, or a combination shelf unit and beverage rack. A refrigeration system circulates refrigerated air within a substantially enclosed interior chilling space formed by the article support assembly to chill the surfaces of the shelf unit and/or beverage rack in the displaying space defined between the transparent outer wall and the article support assembly of the hollow housing, so that the food or beverage items carried thereon in the displaying space are effectively yet indirectly refrigerated via radiation and/or conduction. This unique construction also substantially prevents condensation on the transparent outer wall of the housing of the display apparatus since it is isolated from the flow of refrigerated air in the enclosed interior chilling space.

26 Claims, 7 Drawing Sheets

DISPLAY APPARATUS FOR INDIRECTLY REFRIGERATING FOOD AND BEVERAGE ITEMS

FIELD OF THE INVENTION

This invention relates to portable, refrigerated display units for dispensing and indirectly refrigerating individually packaged food items, such as sandwiches, yogurt, soda cans, bottles, juice cans or boxes and the like.

BACKGROUND

The marketing concept commonly known as "impulse buying" has been used effectively in a variety of retail establishments including supermarkets, convenience food stores, and pharmacies. The idea behind impulse buying is that customers must see certain products before they are motivated to buy. In order to promote impulse buying, such products should be displayed attractively and placed in a location in a store having high customer traffic.

Various types of display techniques have been employed to promote impulse buying. Supermarkets, pharmacies and other retail establishments display articles on hooks, shelves or in bins at the checkout counters where payment is made for one's purchases. Racks or other multiple shelf displays are often found at the ends of aisles, and a variety of smaller, portable displays are placed in the aisles of supermarkets or pharmacies.

Efforts have also been made to generate impulse buying of food products requiring refrigeration. Article displays of this type have generally included transparent doors or walls with shelves which are angled upwardly from front to back so that all articles on the shelves may be seen by customers. Usually these displays are wall-mounted units having large clear glass doors which provide access to the interior. See, for example, U.S. Pat. Nos. 4,489,985, 4,458,501, 3,751,653, 2,863,302, 2,669,851, 1,462,285 and 0,986,875.

Wall-mounted, refrigerated article displays of the type described above present several disadvantages from the standpoint of promoting effective impulse buying. Only the front panel or door of such display devices is clear and thus the product it contains can only be viewed from one direction. In addition, wall-mounted units typically are very large and/or permanently mounted in a particular aisle and thus not portable to various locations around the store. Items such as soft drinks, fruit juices, wine, prepared sandwiches and the like might sell much more quickly if the display apparatus could be moved to a location near the checkout counter of the store or other areas of high customer traffic. Marketing with impulse buying is effective only when the product is located within the customer's view, and very large or permanently mounted wall units often are located in areas of low customer traffic.

Portable, refrigerated display devices have been proposed to improve the effectiveness of impulse marketing of refrigerated items compared to wall-mounted displays. Refrigerated displays of this type generally include a clear housing mounted atop a base having rollers for movement of the display to the desired location. A plurality of spaced shelves are mounted within the interior of the housing which are accessible by opening a single door to the housing. Refrigerated air is introduced into the interior of the housing and directly contacts food items placed on the shelves, either by flowing around and/or through the shelves. See, for example, U.S. Pat. Nos. 4,840,439, 4,744,611, 4,668,028, 4,660,903, 4,523,439, 3,850,486, and 3,797,903.

One problem with portable, refrigerated display devices of the type described above is the formation of condensation on the walls of the clear housing. Because the refrigerated air is introduced throughout the interior of the housing, condensation forms on the housing wall when the door is opened frequently to remove food items or beverages. This condensation prevents visual inspection of the contents of the display unit, unless the door is opened, which significantly reduces the effectiveness of the display unit in promoting impulse buying. Additionally, refrigeration of the entire interior of such display units results in relatively high operating costs because the condenser, blower motor and other elements of the refrigeration system thereof must cycle frequently, if not continuously, in order to maintain the desired temperature within the housing.

Consequently, there is a real need in the industry to alleviate the condensation problem and high operating costs associated with the portable, refrigerated display units presently available to display refrigerated food items and promote impulse buying thereof.

SUMMARY OF THE INVENTION

It is therefore among the objectives of this invention to provide a portable, refrigerated display device particularly intended to enhance impulse buying of food and beverage items which provides a distinctive visual appearance for the items displayed, which effectively and efficiently refrigerates the food or beverage items, which substantially prevents the formation of condensation on the walls of the display device, and which is inexpensive to operate.

These objectives are accomplished in an article display apparatus which comprises a base, a hollow housing having a transparent, outer cylindrical-shaped wall and an article support assembly mounted in the interior of the housing atop a rotatable article support carriage. The article support assembly is variable in construction, depending upon the requirements of a particular retail establishment, and can be adapted to display food items such as sandwiches and the like, beverages such as soda cans, juice boxes, bottles, etc., and/or a combination of such food and beverage items. In order to support food items such as sandwiches, the article support assembly comprises a shelf unit having a series of vertically stacked continuous shelf members which interlock with one another to form a number of vertically spaced continuous shelves which tilt downwardly from the back of the shelf to the front. In order to support beverage cans, bottles, fruit juice boxes and the like, the article support assembly comprises a beverage rack having a plurality of vertically extending, continuous plastic extrusions which are interconnected in a cylindrical shape atop the article support carriage. Each extrusion is formed with semicircular-shaped columns which are adapted to support beverage cans or bottles end-to-end atop the article support carriage. The shelf unit and beverage rack can be used individually within the housing of the article display apparatus, or in combination with one another, to accommodate the types of articles which a given retail sales establishment intends to sell.

An important aspect of this invention is that the stacked shelf members of the shelf unit, or the plastic extrusions of the beverage rack, or a combination of the two, form an article support assembly which defines a substantially if not completely enclosed interior space within the interior of the hollow housing for chilling with refrigerated air, and further defines a displaying space separated from the enclosed interior chilling space for receiving and displaying therein the food items and/or beverages. More particularly, the enclosed interior chilling space is formed by sealing the bottom of the article support assembly with an article support carriage and providing means at the top thereof for substantially preventing the escape of refrigerated air from the enclosed interior chilling space into the displaying space which is formed between the article support assembly and the transparent, outer cylindrical shaped wall of the hollow housing.

In a presently preferred embodiment, refrigerated air is directed into this enclosed interior chilling space of the article support assembly in heat exchange relationship with at least a portion of the individual shelf members of the shelf unit and/or the extrusions forming the beverage rack which form the article support assembly. Because the shelf unit and/or beverage rack form a substantially if not completely enclosed interior chilling space, virtually no refrigerated air is permitted to enter the displaying space of the hollow housing of the article display apparatus, i.e., the space within the hollow housing between the outside of the article support assembly and the transparent outer wall of the housing where the food or beverage items are located for display. Nevertheless, it has been surprisingly discovered that the refrigerated air within the enclosed interior chilling space is effective to cool or chill the shelf members forming the shelf unit, and/or the extrusions forming the beverage rack, so that the food items or beverage containers carried thereon and located in the displaying space are effectively refrigerated.

It should therefore be apparent that the instant invention is predicated upon the novel and unique concept of "indirect" chilling of food items and/or beverages carried by the article support assembly within the displaying space in the hollow interior of the housing of the article display apparatus. Virtually no refrigerated air is blown or passed directly onto the food items or beverage containers carried on the article display apparatus in the displaying space to chill same due to the unique construction of the display devices of the instant invention. Instead, the shelves or columns which support such items are cooled from the inside of the article display apparatus by chilling the enclosed interior chilling space and, in turn, maintain the food items and/or beverages placed thereon in the displaying space refrigerated. In other words, unlike conventional refrigeration devices, refrigeration of food and beverage items is accomplished with the instant invention predominantly by radiation and/or conduction. As one result, this unique yet simple construction amazingly eliminates the formation of condensation on the top and cylindrical walls of the housing of the article display devices and thus permits customers to continuously view the contents of the devices without opening the door. Condensation is reduced or eliminated because the entire interior of the hollow housing of the article display apparatus is not refrigerated by the direct flow of refrigerated air therethrough, since the enclosed interior chilling space of the article support unit carried within such housing receives and retains the refrigerated air. In addition to the substantial elimination of condensation, refrigeration of only the enclosed interior chilling space of the article support assembly reduces operating costs of the display apparatus herein. The present invention therefore has overcome the problems associated with portable, refrigeration display devices available heretofore by a simple, yet novel and unobvious construction.

In one presently preferred embodiment of this invention, the article support assembly comprises a shelf unit mounted atop the article support carriage which extends to the uppermost end of the hollow housing of the article display apparatus. This shelf unit is formed by vertically stacked, alternating top shelf members and bottom shelf members each formed in an annular shape. Preferably, each bottom shelf member comprises a lower annular flange connected to a radially outwardly extending, tapered support wall which terminates with an annular lip. The top shelf members each have an upper annular flange which is adapted to mate with the lower annular flange of a bottom shelf member. The upper annular flange of each top shelf member is integrally connected to a shelf portion which tapers downwardly and extends radially outwardly from the upper annular flange to a lowermost edge formed with an annular hook. The annular hook of a top shelf member is formed to sealingly engage the lip of a bottom shelf member so that alternating top and bottom shelf members interlock with one another to form a vertically extending stack. The top and bottom of the shelf unit are mounted to the top of the housing and the article support carriage at the bottom of the housing, respectively, so that the interior of the shelf unit is completely enclosed. As a result, no refrigerated air is permitted to escape from the enclosed interior chilling space into the displaying space of such a unit where the articles of food and/or beverages are carried and displayed.

In an alternative embodiment of this invention, the article support unit comprises a beverage rack of the type disclosed in U.S. Pat. No. 4,848,856, the disclosure of which is incorporated by reference in its entirety herein. The beverage rack disclosed in U.S. Pat. No. 4,848,856 comprises a number of vertically extending, plastic extrusions which are interconnected in a substantially cylindrical shape and are adapted to mount atop the article support carriage within the housing of the display apparatus. Preferably, each plastic extrusion is formed with two columns comprising a pair of spaced, flexible first and second gripping arms which extend vertically along the entire length of the beverage rack. The first and second gripping arms of each column in an extrusion have opposed article gripping portions and opposed outer ends. The transverse dimension between the opposed article gripping portions of a column is slightly less than the transverse dimension of an article to be held therebetween, e.g., a cylindrical soda can, so that the article gripping portions are deformed to some extent when an article is placed therebetween. The transverse dimension of the opposed outer ends of each column in an extrusion is less than that of the article to be displayed. These outer ends are thus spread apart from an undeflected position to a deflected position as an article is inserted therebetween and into the opposed article gripping portions of the column. The flexible outer ends of the opposed gripping arms return to a substantially undeflected position after an article is positioned between the opposed gripping portions of the column thereby helping to retain the article in place.

Each column in a plastic extrusion forming the beverage rack is substantially semicircular in shape with the gripping arms being interconnected at the rearward or back portion of the column opposite the spaced outer ends of the gripping arms. Each of the opposed article gripping portions of the gripping arms are therefore arcuate in shape and closely conform to the outer surface of cylindrical-shaped items such as soda pop cans, bottles, and the like. Nevertheless, other items having approximately the same transverse dimension as the diameter or space between the opposed gripping portions of the column, e.g., rectangular or square-shaped boxes, etc., can also be held within each column of the beverage rack.

Preferably, each plastic extrusion forming the beverage rack is formed with two columns. In one presently preferred embodiment, a gripping arm of one column is fixedly attached or integrally formed with the gripping arm of the other column in each extrusion. Depending upon the size of the product to be displayed within the columns of an extrusion, an elongated rubber seal may be mounted to the gripping portions of adjacent columns where their gripping arms are connected or integrally formed together to help retain a beverage can or other beverage container within the column.

Locking elements are provided on each two-column extrusion to permit adjacent extrusions to be releasably interconnected together to form the cylindrical-shaped beverage rack. In a presently preferred embodiment, one column of a two-column extrusion has a gripping arm formed with a male locking element, and a gripping arm of the other column in the extrusion is formed with a female locking element. The male locking elements comprise an arm having a T-shaped end, and the female locking elements comprise a U-shaped channel having an elongated slot. In order to interconnect one extrusion to another extrusion, the male locking element on a gripping arm of one extrusion is inserted within the U-shaped channel and through the slot of the female locking element carried on a gripping arm of another extrusion. Any number of two column extrusions can be connected together in this manner to form the article rack.

The locking elements which interconnect adjacent extrusions in the beverage rack are somewhat flexible and are loosely fitted together to permit limited angular adjustment of the position of one extrusion relative to an adjacent extrusion. Adjacent extrusions are angled relative to one another to form the substantially cylindrical-shaped beverage rack, and in the course of bending or angling adjacent extrusions relative to one another, their male and female locking elements form a seal therebetween. As a result, the interior of the beverage rack, i.e., the chilling space, is substantially enclosed and minimal to virtually no leakage of refrigerated air is permitted between the locking elements of adjacent extrusions.

In some applications, it is desirable to form the article support assembly with a combined shelf unit and beverage rack. In an alternative embodiment of this invention, a beverage support rack of the type described above is mounted atop the article support carriage within the interior of the housing of a display device herein, and extends vertically upwardly along only a portion of the height of the housing. An annular plate is mounted at the top end of the beverage rack and this plate supports a shelf unit which extends vertically upwardly therefrom to the top of the housing. Preferably, the hook end of a top shelf member of the shelf unit sealingly engages the outer edge of the annular plate mounted atop the beverage rack so that the combined shelf unit and beverage rack has a substantially if not completely enclosed interior, i.e., the chilling space which is sealed from the remainder of the interior, i.e. the displaying space, of the housing of the display device.

In each embodiment of the article support assembly of this invention, i.e., a continuous shelf unit, a continuous beverage rack or a combination of a shelf unit and beverage rack, a refrigeration system is provided to direct refrigerated air within the enclosed interior chilling space of the article support assembly and to substantially if not completely prevent the escape of refrigerated air therefrom into the displaying space for indirectly refrigerating food and/or beverage items carried thereon. Preferably, the refrigeration system comprises a compressor driven by a motor which are both carried within the base of the article display apparatus. A vertical column is mounted within the enclosed interior chilling space of the article support assembly which is formed with bores in the wall thereof at its top and bottom ends. A vertically extending cooling coil is carried within at least a portion of the interior of the cooling column and is connected by lines to the compressor. A blower is mounted to the top end of the column which is effective to circulate refrigerated air within the enclosed interior chilling space of the article support assembly in a direction from the inlet bores at the base of the column, upwardly through its hollow interior over the cooling coil and then out the outlet bores at the top of the cooling column and into the enclosed interior chilling space.

The cooling column functions to circulate refrigerated air within the enclosed interior chilling space of the article support assembly so that the refrigerated air is brought into heat exchange contact with the shelves of the shelf unit and/or the extruded columns of the beverage rack to indirectly cool food items or beverages carried thereon in the displaying space. As mentioned above, means are provided at the top end of the article support assembly and the bottom end thereof rests atop the article support carriage so that little or no refrigerated air escapes from the enclosed interior chilling space defined by the article support assembly into the displaying space in the hollow interior of the housing of the display apparatus. This ensures that the food items or beverages carried on the shelves or in the beverage support columns of the article support assembly are refrigerated "indirectly", i.e., due to their contact with a refrigerated shelf or column instead of having refrigerated air blown directly thereon.

Another important feature of the refrigeration system is that the temperature of the shelves or beverage support columns at the top of the housing is approximately the same as the temperature of those at the bottom. This is achieved by directing air through the cooling column from the bottom end upwardly over the cooling coil, which is colder at the bottom than the top, and then out the top end into the enclosed interior chilling space of the article support assembly. The cooled air discharged from the top end of the cooling column then flows downwardly within the enclosed interior chilling space of the article support assembly into heat exchange relation with the shelves or beverage support columns toward the base of the cooling column. Preferably, a baffle is located near the base of the cooling column in the enclosed interior chilling space to deflect air outwardly toward the bottom portion of the article support assembly before the air re-enters the cooling column. This air flow path upwardly through the cooling column, downwardly within the enclosed interior chilling space of the article support assembly and then around the baffle, results in a substantially uniform temperature gradient along the height of the article support assembly. That is, the temperature of the shelves or columns near the top of the housing of the article display apparatus is approximately the same as the temperature of the shelves or columns at the base of the display apparatus so that food items or beverage containers placed thereon in the displaying space are cooled to substantially the same temperature.

DESCRIPTION OF THE FIGURES

The structure, operation and advantages of a presently preferred embodiment of this invention will become further apparent upon consideration of the following Description, taken in conjunction with the accompanying FIGS. and Example, wherein.

DETAILED DESCRIPTION OF THE INVENTION

Figure 1:
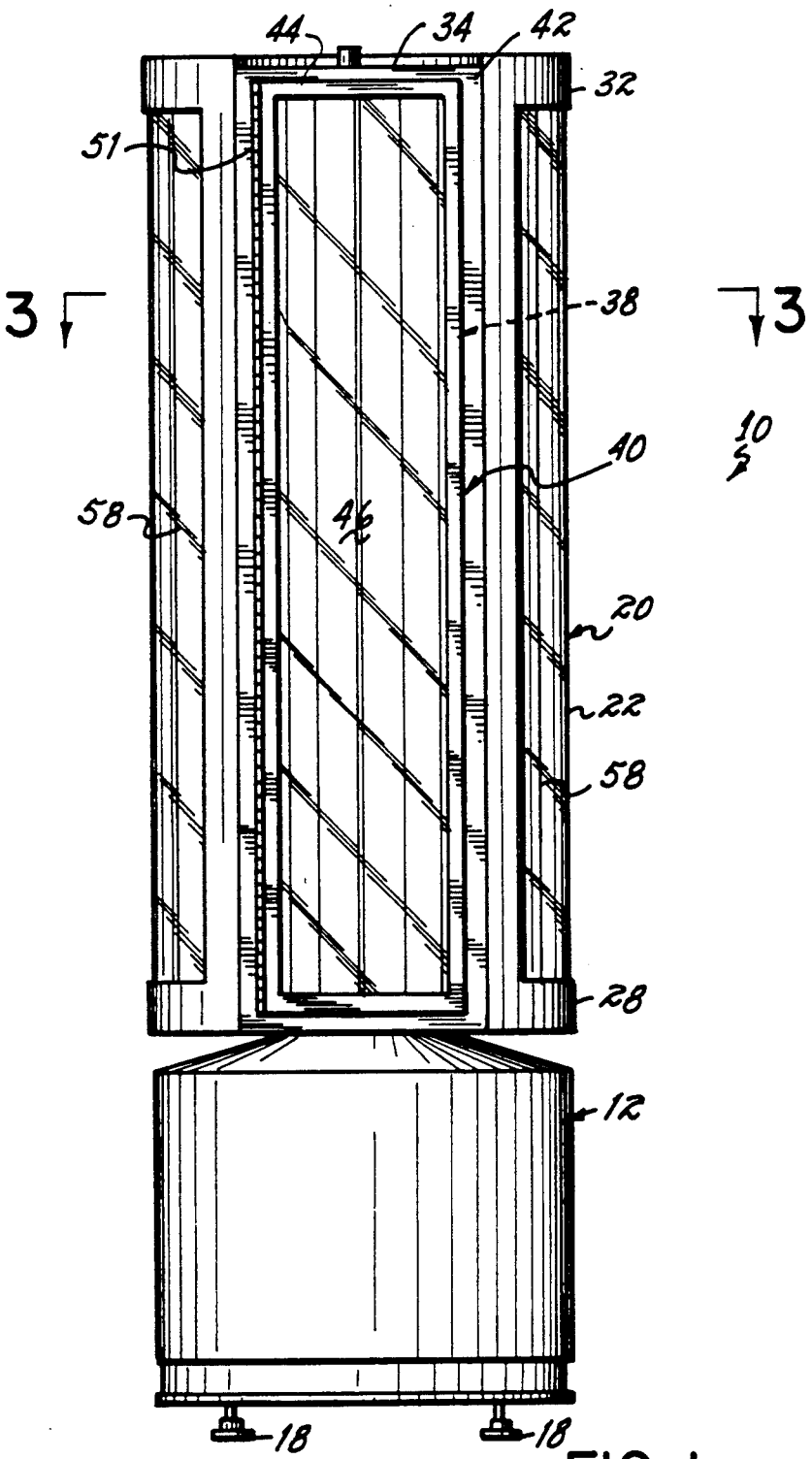
FIG. 1 is a front elevational view of a display apparatus herein.
Figure 2:
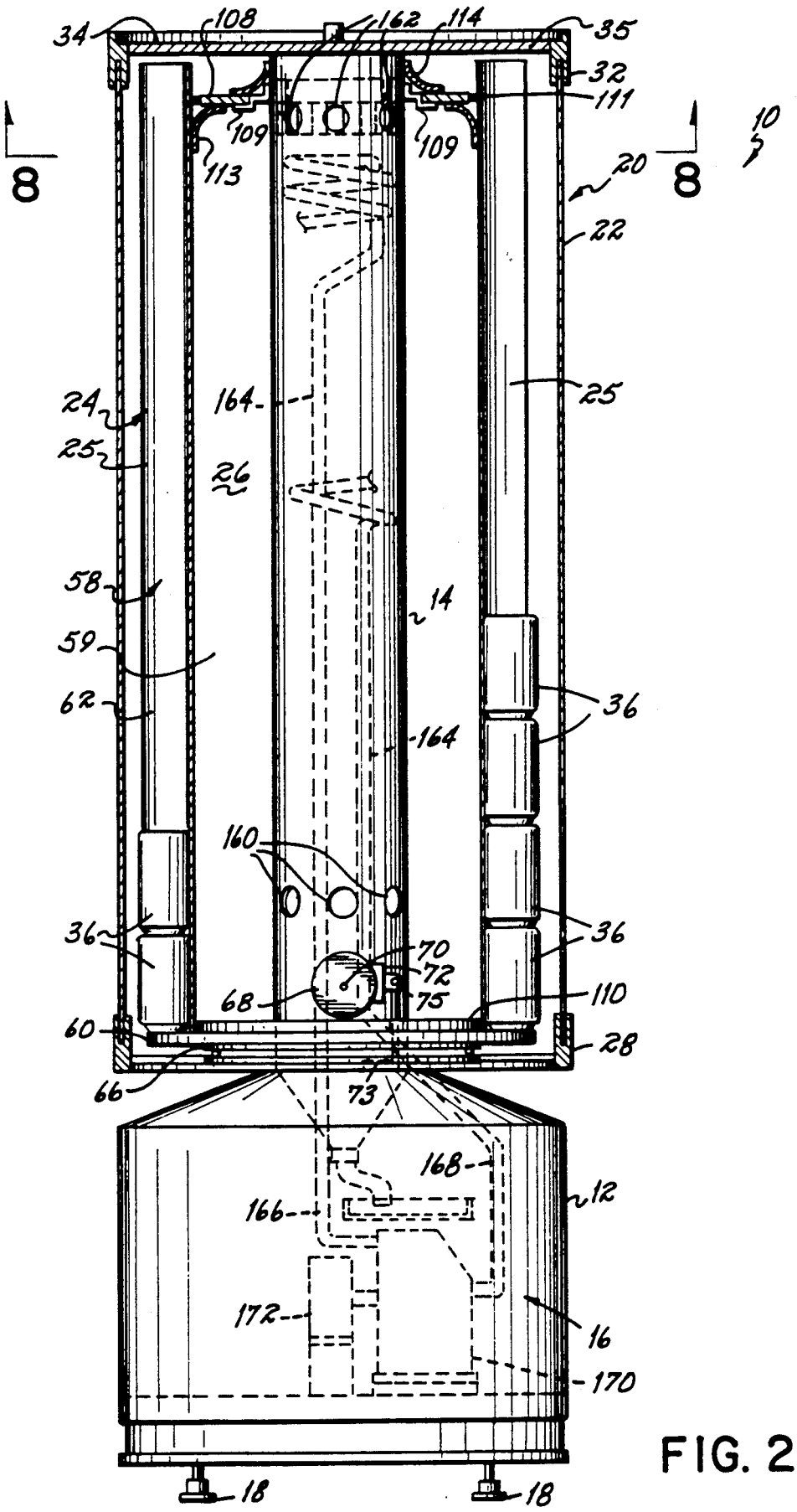
FIG. 2 is an enlarged front view in partial cross section of one embodiment of the display apparatus shown in FIG. 1.

Referring now to FIGS. 1 and 2, one embodiment of the article display apparatus 10 of this invention is illustrated which is similar to that in U.S. Pat. No. 4,848,856, the disclosure of which is incorporated by reference in its entirety herein. The display apparatus 10 includes a base 12 and a vertically extending, cooling column 14 mounted atop the base 12, both of which house a refrigeration system 16 described in detail below. The base 12 and cooling column 14 are hollow and can be formed of metal, plastic or similar material. Preferably, the base 12 is at least partially filled with a material such as concrete for stability, and is supported on the floor by pads 18 or rollers (not shown) so that the article display apparatus 10 is portable and can be readily moved to different locations at a particular retail establishment.

A housing 20 is mounted atop the base 12 which comprises a transparent, cylindrical or other shaped outer wall 22, or walls, defining a hollow interior 24. As shown in FIGS. 2, 3, 5 and 7, the hollow interior is divided into a displaying space 25 for displaying food or beverage items and an enclosed interior chilling space 26 for chilling with refrigerated air to indirectly refrigerate the food and/or beverage items in the displaying space 25. The base of the housing 20 is received within an annular slot formed in an insulative, base plate 28 mounted atop the base 12. The top end of the housing 20 is received within a slot formed in an insulative, annular ring 32 having a seat which supports a cover 34. Preferably, a circular sealing plate 35 is mounted to the bottom of the cover 34 which sealingly engages the inner surface of the annular ring 32 and the top end of cooling column 14, as described in more detail below.

Figure 3:
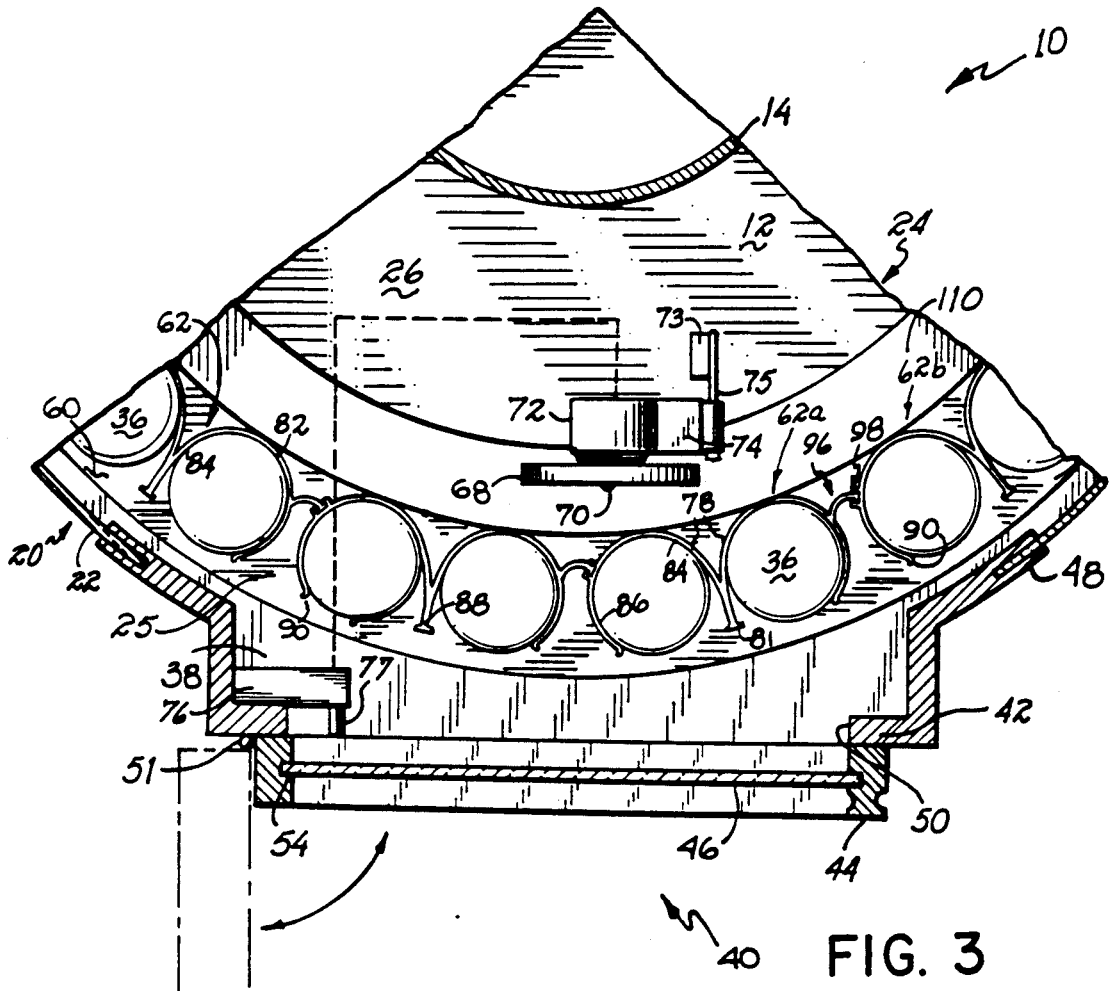
FIG. 3 is a partial cross sectional view of the display apparatus of FIGS. 1 and 2 taken generally along line 3—3 of FIG. 1.

As shown in FIGS. 1 and 3, the housing 20 is formed with an access opening 38 which preferably extends substantially along the majority of the height of the housing 20. A door assembly 40 is mounted over the access opening 38 which comprises a door jamb 42, a door frame 44 and a transparent plate or window 46. The door jamb 42 extends around the periphery of the access opening 38 and has a slot or yoke 48 which is connected to the outer wall 22 of housing 20. The door jamb 42 extends outwardly from the housing wall 22 forming a door opening 50. The door frame 44 is mounted at the door opening 50 of jamb 42 by a piano hinge 51 which extends along one side of the door frame 44. The door frame 44 is formed with a slot 54 which mounts the transparent plate 46. As shown in FIG. 3, the door frame 44 and plate 46 are movable between an open and closed position to permit access into the displaying space 25 in the hollow interior 24 of housing 20.

Figure 4:
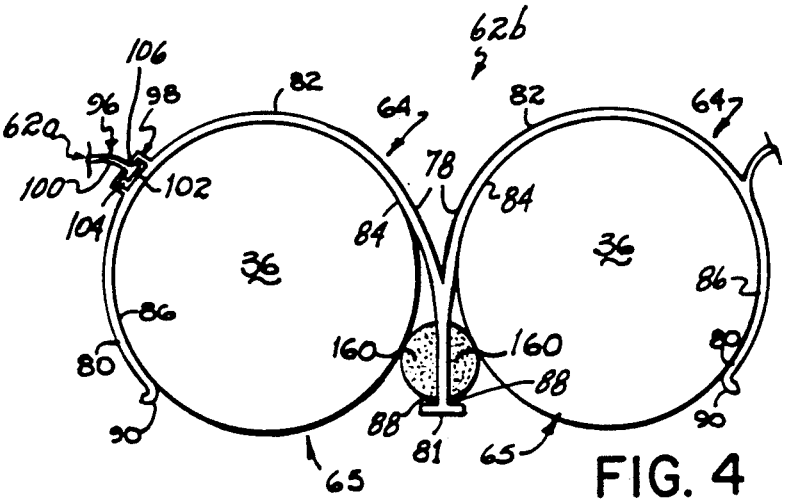
FIG. 4 is an enlarged view of a portion of FIG. 3, with the addition of a gripping pad on the gripper arms of the beverage support rack.

Referring now to FIGS. 2–4, one presently preferred embodiment of an article support assembly of this invention is illustrated wherein beverage containers such as soft drink cans 36 are stacked end-to-end within the vertical columns of a beverage rack 58 mounted atop an article support carriage 60 within the displaying space 25 in the hollow interior 24 of the display apparatus housing 20. The article support carriage 60 is mounted on a lazy-susan type bearing 66 carried on the base 12 at the bottom of the housing 20. The article support carriage 60 is rotated on bearing 66 with respect to the fixed housing 20 by a friction wheel 68 drivingly connected to the output shaft 70 of a motor 72. Preferably, the motor 72 is pivotally mounted within the interior 24 of housing 20. An angle bracket 73, fixed to the base 12, extends vertically into the interior 24 of housing 12. At its upper end, within the housing interior 24, the bracket 73 has a pivot shaft 75 fixedly secured thereto. Pivotably mounted on shaft 75 is a flange 74 to which the motor 72 is mounted. The friction wheel 68 rests atop a lower annular spacer 110 of the article support carriage 60 and is rotated by the motor 72, which, in turn, causes the beverage support carriage 60 and article support rack 58 to rotate with respect to the base 12 and housing 20.

As shown schematically in FIG. 3, operation of the motor 72 is controlled by a switch 76 activated by a wire or rod 77 connected to the door frame 44. Preferably, with the door frame 44 in a closed position, the switch 76 is closed by the rod 77 so that the motor 72 is operated to drive the friction wheel 68 and continuously rotate the article support carriage 60 and beverage rack 58. When the door frame 44 is moved to an open position, shown in phantom in FIG. 3, the switch is also opened by movement of rod 77 which deactivates the motor 72 and stops the rotation of article support carriage 60 and rack 58.

Referring now to FIGS. 3 and 4, the construction of a presently preferred embodiment of the beverage rack 58 is shown in detail. The beverage rack 58 comprises a plurality of interconnected plastic extrusions 62 each having a pair of vertically extending columns 64 for mounting cans 36 or other beverage containers. Each of the two columns 64 forming an extrusion 62 is generally semicircular in shape having a pair of opposed gripping arms 78, 80 which are connected together at an arcuate, back portion 82. Preferably, the extrusion 62 is formed such that the gripping arm 78 of one column 64 is attached to or integrally formed with the gripping arm 78 of an adjacent column 64 in the same extrusion 62.

In a presently preferred embodiment, the gripping arms 78, 80 of each column 64 are formed with opposed, internal gripping portions 84, 86, respectively, which are adapted to frictionally grip an article such as a soda can 36 therebetween. The transverse dimension between the gripping portions 84, 86 of each column 64 in the undeflected position is preferably slightly less than the diameter of the soda can 36 to ensure that the articles 36 are frictionally held along the columns 64.

Each gripping arm 78, 80 of a column 64 is also formed with elongated outer ends 88, 90, respectively, opposite the back portion 82. The outer ends 88, 90 of each column 64 are spaced from one another a distance which is smaller than the diameter of article 36 defining an elongated access opening 65 therebetween. The outer ends 88 of the interconnecting gripping arms 78 of the extrusion 62 form a T-shaped end 81 which separates the two columns 64 of the extrusion 62. The outer end 90 of each gripping arm 80 is bent slightly outwardly away from the opposite gripping arm 78 to facilitate insertion or removal of an article into or from elongated columns 64, respectively.

As discussed in U.S. Pat. No. 4,848,056, it is recognized that greater variation of the transverse dimension between the gripping portions 84, 86 of each column 64 may be desirable for certain retail establishments. Whereas the gripping portions 84, 86 are capable of securely gripping an item such as article 36 having a given diameter, e.g., a 12 ounce soda can, other items which a seller may want to display such as those having a significantly smaller diameter or items which do not closely conform to the shape of the gripping portions 84, 86 might not be as securely held therebetween. In order to provide for the support of a wider variety of items within the columns 64, an elongated strip 160 is mounted to each of the adjoining gripping arms 78 of the two columns 64 at or near the outer, T-shaped end 81 which is formed of a resilient, compressible material such as neoprene rubber to engage a beverage can 36 or other item and hold it in place between the gripper arms 84, 86.

As shown in FIGS. 3 and 4, adjacent extrusions 62 are interconnected with locking elements to form the beverage rack 58. A male locking element 96 is formed on the gripping arm 80 of the righthand column 64 of an extrusion **62*a* as viewed on the right-hand portion of FIG. 3, and a female locking element 98 is formed on the gripping arm 80 of the lefthand column 64 of extrusion 62*b*. The male locking element 96 comprises a flexible arm 100 having a T-shaped end 102. The female locking element 98 comprises a U-shaped channel 104 having a longitudinally extending slot 106. As shown in FIG. 3, the extrusion 62*a* is interconnected with extrusion 62*b* by inserting the T-shaped end 102 of the male locking element 96 of extrusion 62*a* into the U-shaped channel 104 and slot 106 of the female locking element 98 formed on extrusion 62*b*. Other extrusions are then connected to extrusions 62*a*, 62*b* in the same manner to form the completed beverage rack 58**.

Figure 8:
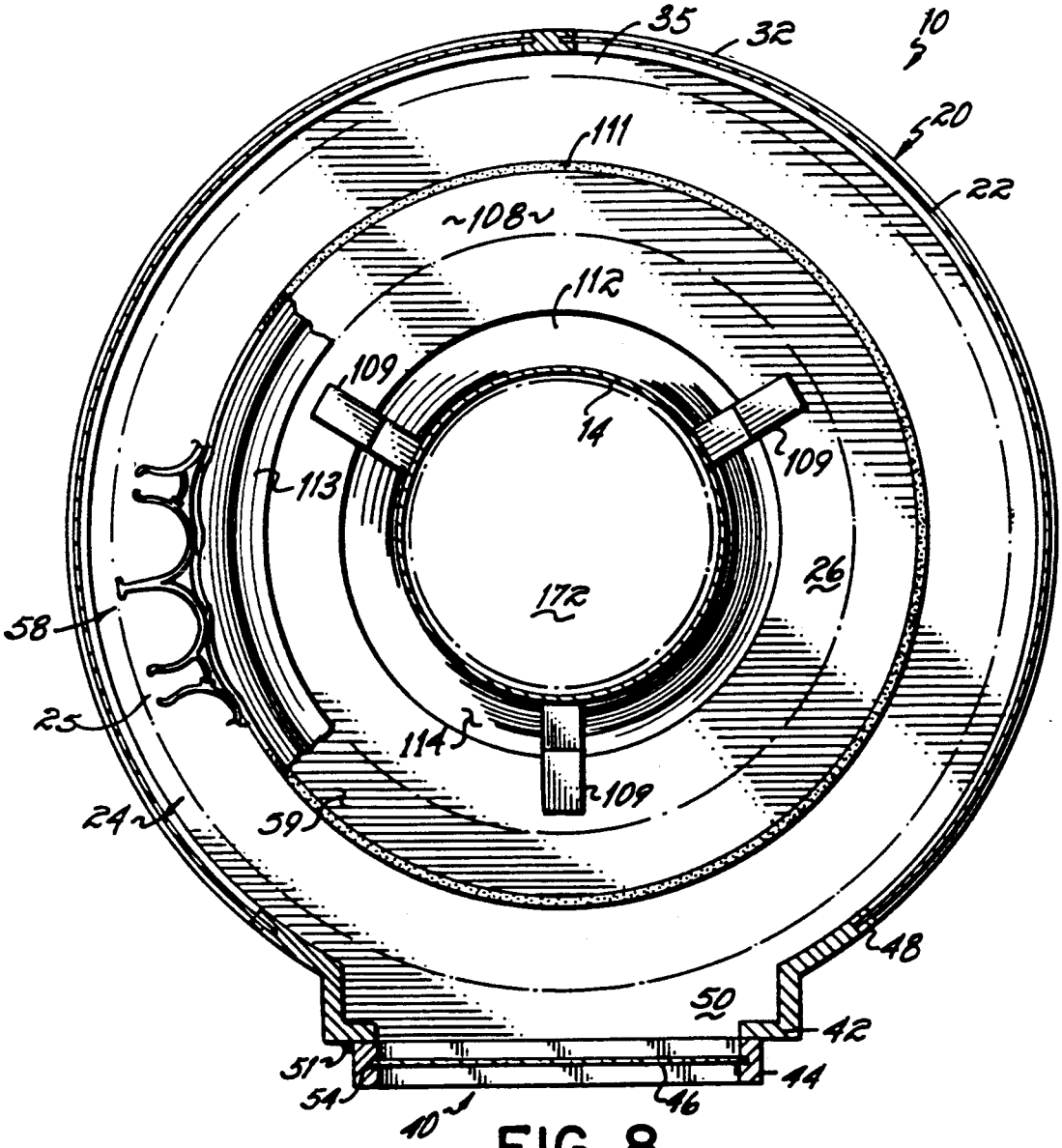
FIG. 8 is a cross sectional view of the display apparatus of FIGS. 1 and 2 taken generally along line 8—8 of FIG. 2.

A relatively loose fit is provided between the male and female locking elements 96, 98 which permits adjacent extrusions 62 to be positioned at an angle relative to one another. A large number of extrusions 62 can thus be made to conform to a substantially cylindrical shape. As shown in FIGS. 2 and 8, the top of interconnected extrusions 62 of the vertically extending cylindrical-shaped beverage rack 58 lies adjacent to the annular periphery of an upper annular ring or spacer 108 resting on three brackets 109 mounted to the top of cooling column 14. The bottom of the beverage rack 58 is mounted to a lower annular spacer 110 mounted atop the annular article support carriage 60 at the bottom of the housing 20, as depicted in FIGS. 2 and 3. These spacers 108, 110 formed can be of, for example, wood or rigid plastic material and function to maintain the extrusions 62 in an annular shape and prevent the extrusions 62 from collapsing radially inwardly when articles 36 are positioned therein or removed therefrom.

As part of annular spacer 108, there is an annular seal 111 attached thereto, via an adhesive, which is formed of a resilient material, such as neoprene rubber. It should be understood that with the construction illustrated in FIG. 2, there is a small annular gap 112 between cooling column 14 and annular spacer 108, as shown in FIG. 8. Moreover, when annular spacer 108 is formed of a wooden material which does not include annular seal 111 (not shown), annular spacer 108 does not conform as tightly to the top portion of extrusions 62 of the vertically extending cylindrical-shaped beverage rack 58. Consequently, a larger gap (not shown) will also exist therebetween from which refrigerated air may escape therethrough and into displaying space 25. Therefore, it has been discovered that the addition of annular seal 111 to annular spacer 108 reduces the size of the gap between annular spacer 108 and the top portion of extrusions 62 of the vertically extending cylindrical-shaped beverage rack 58 by conforming more tightly thereto, as illustrated in FIG. 8. As a result, annular seal 111 helps to prevent the escape of refrigerated air therethrough and into display space 25. It has also been discovered that the addition of annular seal 111 to annular spacer 108 helps the display unit to operate more quietly, especially when vertically extending cylindrically-shaped beverage rack 58 s rotated within the housing 20.

It should therefore be appreciated that with the inclusion of annular seal 111, the enclosed interior chilling space 26 of the beverage display unit shown in FIG. 2 is sufficiently enclosed to accomplish the objectives of the instant invention, i.e., indirect refrigeration, even though annular gap 112 as depicted in FIG. 8 exists between cooling column 14 and annular spacer 108. It should also be appreciated that annular spacer 108 may be formed entirely of a resilient material which can tightly conform to the top portion of extrusions 62 of vertically extending cylindrically-shaped beverage rack 58 so long as it is sufficiently rigid to prevent the extrusions 62 from collapsing radially inwardly when articles 36 are positioned therein or removed therefrom and the objectives of the instant invention are not defeated.

To further prevent the escape of refrigerated air from the interior chilling space 26 of the beverage display unit illustrated in FIG. 2 into the displaying space 25, a convex-shaped annular deflector 113 can be connected via staples to annular spacer 108 and the top portion of extrusions 62 of vertically extending cylindrically-shaped beverage rack 58, without interfering with the rotation of the beverage rack 58, as shown in FIGS. 2 and 8. This convex-shaped annular deflector 113 not only helps to prevent the escape of refrigerated air from the interior chilling space 26, but it also helps to deflect the refrigerated air expelled from the air outlets 162 in cooling column 14 in a downwardly direction within the interior chilling space 26 toward the air inlets 160 in cooling column 14.

To further enclose interior chilling space 26 of the beverage display unit illustrated in FIG. 2, a concave-shaped annular member 114 can be connected to the cooling column 14 so that the bottom portion thereof rests atop annular spacer 108 above brackets 109, as depicted in FIGS. 2 and 8. Because of the strategic location of concave-shaped annular member 114, the small annular gap 112 which exists between the cooling column 14 and the annular spacer 108 is closed. Moreover, the rotation of annular spacer 108 is not hindered. As a result, when annular seal 111, convex-shaped annular deflector 113 and concave-shaped annular member 114 are installed, it should be appreciated that the interior chilling space 26 is substantially closed so that virtually no refrigerated air escapes therefrom and into displaying space 25. It should of course be realized that while annular seal 111, convex-shaped annular deflector 113 and concave-shaped annular member 114 can be installed individually or in any combination to achieve the objectives of the instant invention, the objectives of the instant invention are believed to be better accomplished when all three components are installed on the beverage display unit illustrated in FIGS. 2 and 8 for the reasons described above. It should of course be further realized that means alternative to those described above may be employed to enclose the interior chilling space 26 of the beverage display units as depicted in FIGS. 1–2 and are within the contemplation of the instant invention so long as the objectives of the instant invention are not defeated.

Importantly, the bending or angulation of one extrusion 62 relative to another in forming the cylindrical-shaped beverage rack 58 causes the locking elements 96, 98 of adjacent extrusions 62 to seat against one another forming a substantially air-tight seal therebetween. The bottom end of the beverage support rack 58 is sealed on the article support carriage 60 to prevent the escape of refrigerated air therethrough. As set forth hereinbefore, the top of the beverage support rack 58 is further closed by the inclusion of annular seal adjacent spacer 108, convex-shaped annular deflector 113 and/or concave-shaped annular member 114. As a result, the beverage rack 58 is formed such that interior chilling space 26 is substantially enclosed and isolated from the displaying space 25 in the hollow interior 24 of the housing 20 which is outside of the beverage rack 58, i.e., between the exterior surface of the beverage rack 58 and the transparent outer wall 22 of housing 20. Moreover, as depicted in FIG. 2, beverage rack 58 is formed such that the interior chilling space 26 surrounds cooling column 14 and isolates it from displaying space 25. This structural relationship is important for purposes of refrigeration, as discussed in detail below.

Figure 5:
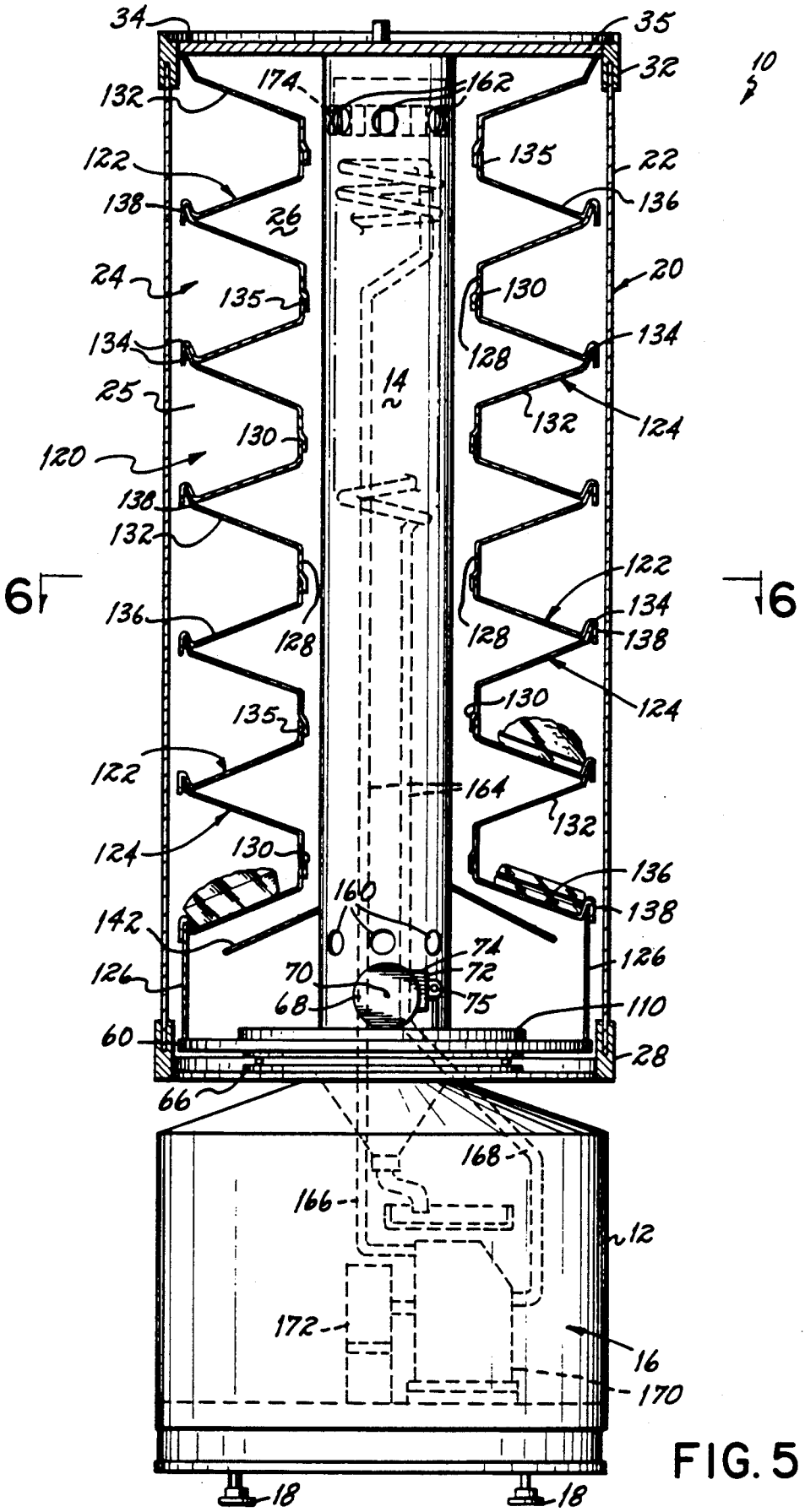
FIG. 5 is a view similar to FIG. 2 of an alternative embodiment of the display apparatus herein having a vertically extending shelf unit.
Figure 6:
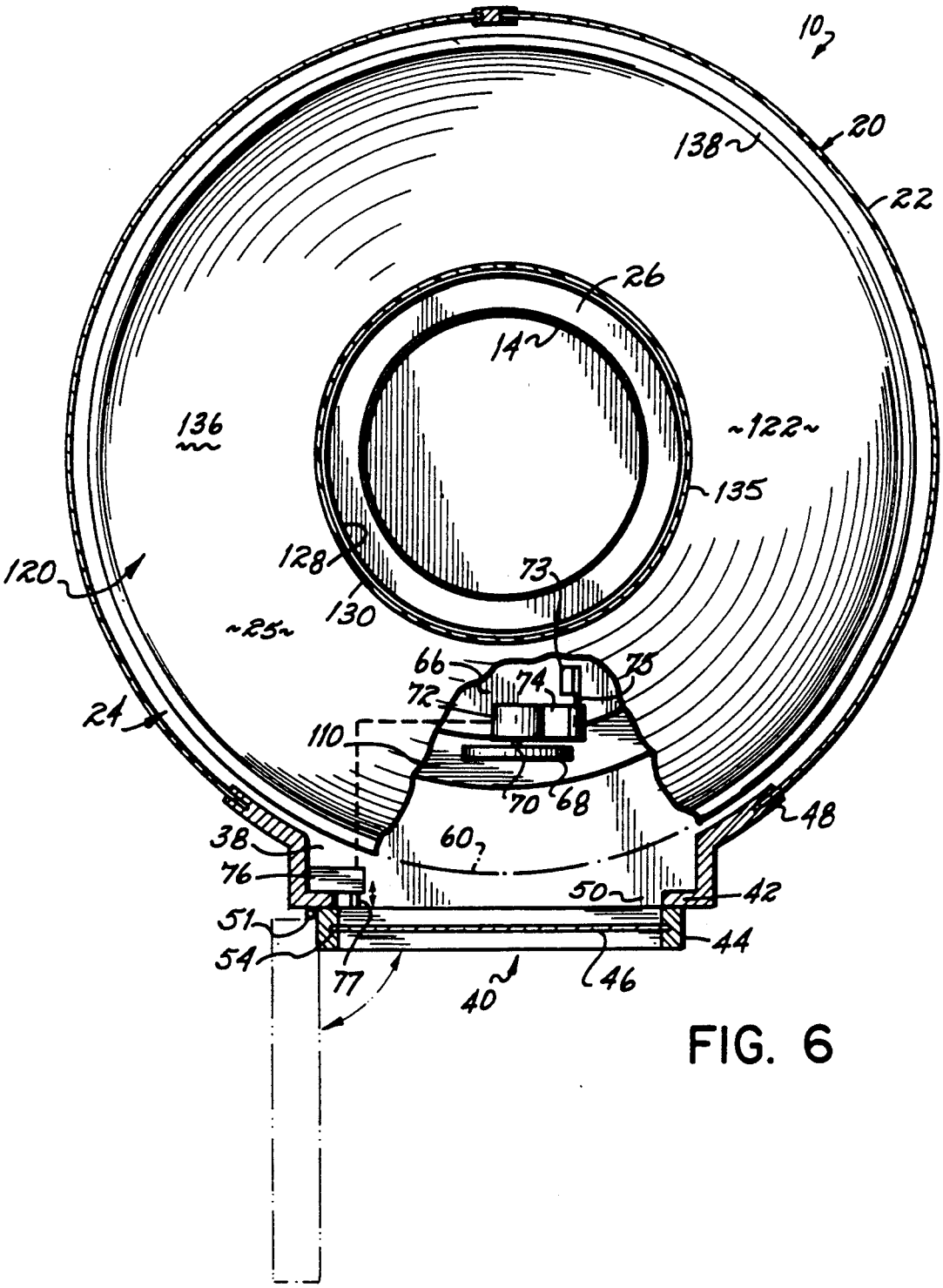
FIG. 6 is a cross sectional view taken generally along line 6—6 of FIG. 5.

Referring now to FIGS. 5 and 6, an alternative embodiment of this invention is illustrated which is identical to that discussed in FIGS. 1–4 except the beverage rack 58 is removed and replaced with a shelf unit 120 having shelf surfaces for supporting food items such as prepared sandwiches and the like. Structural elements appearing in such FIGS. which are common to those described above in connection with FIGS. 1–4 are given the same reference numbers in FIGS. 5 and 6. The shelf unit 120 comprises a number of stacked, interlocking upper shelf members 122 and lower shelf members 124 which extend vertically upwardly within the housing 20 between an annular base 126 mounted atop the article support carriage 60 at the base of housing 20, and the sealing plate 35 at the top of the housing 20.

As illustrated in FIG. 5, each lower shelf member 124 comprises a lower annular flange 128 having a radially inwardly extending, offset end 130. The annular flange 128 is integrally connected to a flared support wall 132 which slopes upwardly and radially outwardly with respect to the annular flange 128 and terminates with an annular lip 134.

Each upper shelf member 122 comprises an upper annular flange 135 which is adapted to mate with the outer surface of the offset end 130 of a lower shelf member 124. The upper annular flange 135 of upper shelf member 122 is integrally connected to an annular shelf portion 136 for supporting food items which tilts or slopes in a downward direction, i.e., from back to front, and terminates at its lower end with an annular hook 138. This annular hook 138 sealingly engages the lip 134 of a lower shelf member 124 to interlock the upper and lower members 122, 124. The upper and lower shelf members 122, 124 are vacuum formed or injection molded from a plastic material, preferably a clear thermoplastic material, such as a polyvinyl chloride (PVC), an acrylonitrile-butadiene-styrene (ABS), or a polyester such as a polyethylene terephthalate glycol modified commonly known as PETG and sold by Eastman Kodak Co. In accordance with the instant invention, shelf members 122, 124 preferably have a thickness of about 0.09" and are formed with PETG.

The surfaces of the shelf members 122, 124 which interconnect with one another, e.g., the flanges 128, 135 and the lip 134 and hook 138, are preferably permanently connected by a solvent, cement or other type of adhesive material to form a virtually air-tight seal between the upper shelf members 122 and lower shelf members 124. In the embodiment of FIGS. 5 and 6, an annular baffle 142 is mounted to the base of the cooling column 14 and extends radially outwardly therefrom within the annular base 126 beneath the lowermost shelf member 122, for purposes to become apparent below.

As shown in FIG. 5, alternating upper and lower shelf members 122, 124 are secured together as described above to form a vertically stacked shelf unit 120 extending from the annular base 126 to the sealing plate 35. Preferably, the lip 134 of a lower shelf member 124 sealingly engages the sealing plate 35 at the top of housing 20 and a hook 138 of an upper member 122 sealingly engages and fixedly attaches to the annular base 126. Because each of the connections between the upper and lower shelf members 122, 124 form a substantially air-tight seal, as described above, the interior chilling space 26 formed by the shelf unit 120 of the food display device as illustrated in FIG. 5 encloses the cooling column 14 and effectively isolates it from the displaying space 25 in the hollow interior 24 of housing 20. Moreover, the interior chilling space 26 formed by the shelf unit 120 is virtually enclosed thereby substantially, if not completely, preventing the escape of refrigerated air therefrom and into the displaying space 25.

Figure 7:
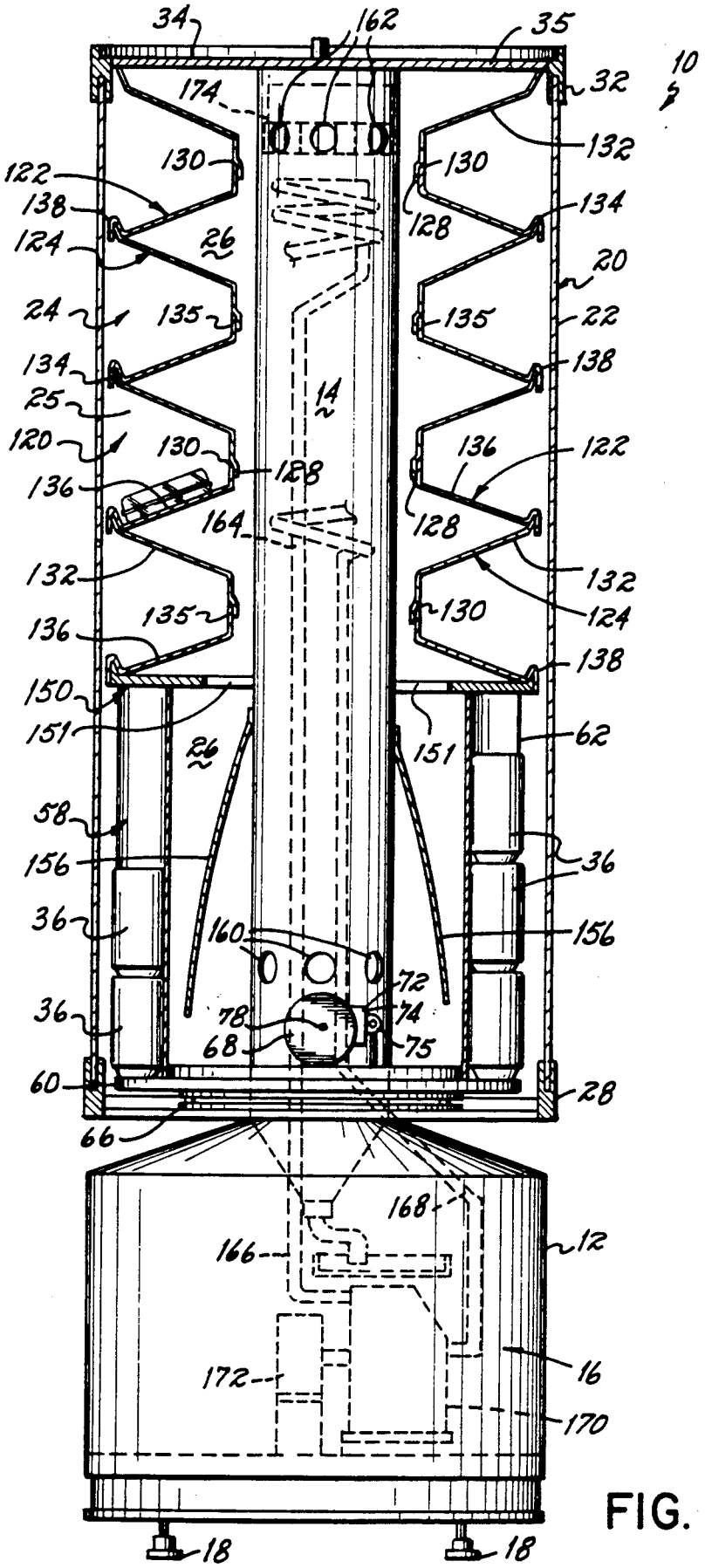
FIG. 7 is a view similar to FIGS. 2 and 5 of a still further embodiment of the article display apparatus of this invention, including a combined shelf unit and beverage rack.

Referring now to FIG. 7, a still further embodiment of an article display apparatus according to this invention is illustrated having an article support assembly which is a combination of the beverage rack 58 shown in FIGS. 1–4 and the shelf unit 120 shown in FIGS. 5 and 6. In this embodiment, a truncated beverage rack 58 is mounted atop the article support carriage 60, but extends vertically upwardly therefrom only along a portion of the height of the housing 20 of apparatus 10 An annular ring 150 is mounted atop the beverage support rack 58 which extends radially inwardly to the cooling column 14 and is formed with openings 151. This annular ring 150 mounts a shelf unit 120 of the type described in connection with FIGS. 5 and 6. The hook 138 of an upper shelf member 122 of shelf unit 120 sealingly engages the periphery of the plate 150, and the stacked, interconnected upper and lower shelf members 122, 124 extend upwardly to the sealing plate 35 at the top of housing 20 such that a lip 134 of a lower shelf member 124 of shelf unit 120 sealingly engages the sealing plate 35.

The shelf unit 120 and beverage rack 58 together form a substantially enclosed interior chilling space 26 which encloses the cooling column 14 and separates it from the displaying space 25 in the hollow interior 24 of the housing 20 of display apparatus 10. Preferably, an elongated, annular baffle 156 is mounted to the cooling column 14 near the annular ring 150 and extends downwardly toward the base of cooling column 14 and article support carriage 60 for purposes to become apparent below.

An important aspect of this invention is the formation of a refrigerated article display apparatus 10 having an article support assembly in which food items placed on the shelves of the shelf unit 120 and/or beverage containers carried in the beverage rack 58 are cooled "indirectly", i.e., by radiation and/or conduction from the surfaces which support such items as opposed to direct contact with refrigerated air. This is accomplished in each of the embodiments of this invention by directing a flow of refrigerated air within the substantially enclosed interior chilling space 26 of beverage rack 58 as illustrated in FIGS. 1–4, the shelf unit 120 as shown in FIGS. 5 and 6, or a combination of the two as depicted in FIG. 7, such that most, if not all, of the refrigerated air is prevented from entering into the displaying space 25 in the hollow interior 24 of housing 20, i.e., between the outer surface of the beverage rack 58 and/or shelf unit 120 and the outer wall 22 of the housing 20. As a result, the exterior surfaces of the beverage rack 58 and/or shelf unit 120 in the displaying space 25 are cooled by contact of the interior surfaces thereof with the refrigerated air in the substantially enclosed interior chilling space 26 and thus the food items or beverages placed into contact therewith in the displaying space 25 also become cooled. Thus, it should be now apparent to those versed in this art that refrigeration of food items or beverages in accordance with the instant invention is accomplished by "indirect refrigeration", as opposed to "direct refrigeration" or a combination of "direct and indirect refrigeration", since most, if not all, of the refrigerated air is prevented from escaping into the displaying space 25 to make direct contact with the food items or beverages displayed therein.

Each of the embodiments illustrated in FIGS. 1–7 incorporate a refrigeration system 16 carried in the base support 12 and in the cooling column 14. In the presently preferred embodiment, the wall of the cooling column 14 is formed with a plurality of spaced air inlet openings 160 at the bottom end thereof above the article support carriage 60, and a plurality of air outlet openings 162 at the top end thereof beneath the sealing plate 35. A cooling coil 164 is mounted within the interior of the hollow cooling column 14 between the openings 160, 162 and is connected by an inlet line 166 and an outlet line 168 to a compressor 170 mounted within the base 12. The compressor 170 is driven by a motor 172 also housed within the base 12. A blower 174 is carried at the top end of the cooling column 14 adjacent the air outlet openings 162.

The refrigeration system 16 of this invention operates as follows. The blower 174 draws air through the inlet openings 160 into the interior of the cooling column 14, over the cooling coil 164 and out the outlet openings 162. The annular spacer 108 and annular seal the convex-shaped annular deflector 113 and/or the concave-shaped annular member 114 of the beverage display unit as depicted in FIGS. 2 and 8, or the sealing plate 35 in sealing engagement with the shelf 120 of the food or combination display units of FIGS. 5 and 7, respectively, act to substantially, if not completely, block the flow of refrigerated air into the displaying space 25 in the hollow interior 24 of the housing 20 so that the refrigerated air is directed into only the enclosed interior chilling space 26 of the beverage display device shown in FIGS. 1–4, or of the food-type display device of FIGS. 5 and 6, or of the combined food-type and beverage display device of FIG. 7.

The thermostat (not shown) is located in the cooling column 14 below the cooling coils 164 adjacent the openings 160. The thermostat is preferably set at a temperature of about 38° F. or at a temperature so that the products stored on the shelf members 122 or on the beverage racks 58 are maintained at a preferred temperature of about 38° F. When the thermostat is set at 38° F., the temperature within the cooling column 14 is typically at 25° F. This temperature within the cooling column 14, however, may be in the range of about 20° F. to about 30° F. and preferably at 25° F. It should be understood that if the thermostat is set too low and the temperature within the cooling column 14 dips below about 20° F., excessive frost build up may occur. The refrigerated air blown out of the outlet openings 162 is at a preferable temperature in the range between about 34° F. and 40° F. and preferably at about 38° F. and flows into heat exchange contact with the inside surfaces of food or beverage supports to reduce their temperature to a preferable temperature in the range between about 34° F. and 40° F. and more preferably to the temperature of about 38° F., such that the food items or beverages located in the displaying space 25 are likewise cooled to the preferable temperature range between about 34° F. and 40° F. and more preferably to the temperature of about 38° F. The baffle 142 in the embodiment of FIGS. 5 and 6 and the baffle 156 in the embodiment of FIG. 7 function to direct the downwardly flowing refrigerated air in the enclosed interior chilling space 26 past the lowermost surfaces of the shelf unit 120 or beverage rack 58 before such refrigerated air re-enters the column 14 through the lower air inlets 160 therein. This ensures that such lowermost surfaces of the shelf unit 120 and beverage rack 58 are properly cooled, and that a minimal temperature differential is obtained between the food or beverage support surfaces at upper ends of the shelf unit 120 and/or beverage rack 58 and such surfaces at the lower ends thereof.

The refrigeration system 16 of this invention is effective to chill the inner and outer surfaces of the plastic extrusions 62 forming the beverage rack 58 and the shelf portions 136 of the upper members 122 of shelf unit 120 which are located in the displaying space 25 of the hollow interior 24 so that food items or beverage containers placed into contact therewith also become cool. In accordance with the instant invention, since virtually no refrigerated air is blown directly onto food items carried on the shelf portions 136 or in the columns of beverage rack 58, any cooling of the displaying space 25 in the hollow interior 24 of housing 20 is by radiation and/or conduction from the food or beverage support surfaces. The displaying space 25 in the hollow interior 24 of the housing 20 of display unit 10 is maintained at a preferable temperature of about 50° F., whereas the food items or beverage containers held by the shelf unit 120 or beverage rack 58 are maintained at a preferable temperature of about 38° F. Because virtually no refrigerated air is allowed to enter the displaying space 25 in the hollow interior 24 of the housing 20, condensation on the top 35 and the wall 22 of housing 20 is substantially eliminated even if the door 46 is inadvertently left opened or repeatedly opened and closed to remove product therefrom.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of this invention without departing from the essential scope thereof.

For example, the refrigeration system 16 illustrated in the FIGS. employs a cooling coil 164 mounted within the interior of the cooling column 14 and a blower 174 carried at the top end of the cooling column 14. It is contemplated, however, that other refrigeration systems could be employed so long as a flow of refrigerated air is directed along a path wherein the refrigerated air flows upwardly within the interior of the cooling column, out of the bores at the top of the column, into the enclosed interior chilling space 26 and downwardly along the outside of the cooling column and in heat exchange relationship with the inner surfaces of the shelf unit 120 and/or beverage rack 58 in the enclosed interior chilling space 26, and then back into the interior of the cooling column through air inlets at the bottom thereof. As another alternative arrangement, two or more cooling columns could be employed within the enclosed interior chilling space so that the refrigerated air travels in heat exchange relationship with the inner surfaces of the shelf unit 120 and/or beverage rack 58 as it is directed upwardly therethrough.

The present invention will now be further illustrated with reference to the following example.

EXAMPLE

A portable, refrigerated display unit 10 as depicted in FIG. 5 is assembled and operated in accordance with the present invention. The shelf unit 120 including the shelf members 122 and 124 are formed with PETG and have a thickness of approximately 0.09". The copper cooling coil, as shown in phantom in FIG. 5, is mounted within the cooling column 14 between openings 160, 162 and is connected between an inlet and outlet line 166, 168, respectively, to a compressor 170 mounted in base 12, as also shown in phantom in FIG. 5. The compressor 170 is driven by a 1/5 h.p. motor 172, also depicted in phantom in FIG. 5, in base 12. Mounted atop the copper cooling coil within the cooling column 14 is a blower 174, as also shown in phantom in FIG. 5, to draw air through the inlet openings 160, over the cooling coils in the cooling column 14, and out the outlet openings 162 into the enclosed interior chilling space 26 which is substantially sealed. The sealing plate 35 prevents the refrigerated air from flowing into the displaying space 25 of the housing 20 so that the refrigerated air exiting from the outlet openings 162 is directed into only the enclosed interior chilling space 26. The annular baffle 142 functions to direct the downwardly flowing refrigerated air in the enclosed interior chilling space 26 toward and against the lowermost surfaces of the shelf member 122 of the shelf unit 120.

The display apparatus 10 of this Example is operated for approximately one week without any product carried on the shelf members 122, and is again operated for approximately one week with transparent, moisture impervious sandwich size locking plastic bags filled with a selected quantity of water carried on the shelf members 122. For each of the one week testing periods, the thermostat (not shown), which is located in the cooling column 14 below the copper cooling coil 5 contiguous to the openings 160, of the display apparatus 10 is set at a preferable temperature of about 38° F. or at a temperature to maintain the products stored on the shelf members 122 at a preferable temperature of about 38° F.

During each of the one week testing periods that the shelf members 122 ar free of product or carry the plastic bags filled with water thereon, the air temperature in the cooling column 14 remains substantially constant at about 25° F. The temperature of the enclosed interior chilling space 26 and the shelf members 122 during either of the one week testing periods also remains substantially constant, but at about 38° F. The temperature of the displaying space 25 in the hollow interior 24 of the housing 20 during either of the one week testing periods likewise remains substantially constant, but at about 50° F.

During the one week testing period that the plastic bags filled with water are carried on the shelf members 122, the temperature of the water in each of the plastic bags on the different shelf members 122 also remains substantially constant at about 38° F., varying only within about 2 or 3 degrees of one another between the temperature of the water in the plastic bags carried on the uppermost shelf member 122 as compared to the temperature of the water in the plastic bags carried on the lowermost shelf member 122.

Therefore, it is intended that the invention not be limited to the particular embodiment disclosed as the best mode contemplated for carrying out this invention, but that the instant invention will include all embodiments falling within the scope of the appended claims.

We claim:

1. An article display apparatus, comprising:

a base support;

a housing having an outer wall and a hollow interior, said housing being mounted to said base support;

door means mounted over an opening formed in said outer wall of said housing for permitting access to said hollow interior of said housing;

an article support carriage mounted to said base support at the bottom of said housing;

an article support assembly mounted atop said article support carriage within said hollow interior of said housing, said article support assembly comprising a wall having an inner surface which defines a substantially enclosed interior space for substantially preventing the escape of refrigerated air therefrom and an outer surface which defines a displaying space between said wall and said outer wall of said housing, said outer surface of said wall including a plurality of food support means for carrying articles of food and/or beverages in said displaying space;

means for rotating said article support carriage when said door means is closed so that said article support assembly and said plurality of food support means are rotated simultaneously within said housing; and means for supporting refrigerated air into said substantially enclosed interior space of said article support assembly, so that the refrigerated air is brought into heat exchange relationship with respect to at least a portion of said inner surface of said wall of said article support assembly whereby said food support means of said article support assembly is chilled by the refrigerated air in within said substantially enclosed interior space for indirectly refrigerating articles of food and/or beverages carried thereon in said displaying space.

2. The article display apparatus of claim 1 in which said article support assembly comprises:

a number of alternating first shelf members and second shelf members interconnected to one another to form a substantially enclosed interior;

one of said first and second shelf members being formed with a shelf portion for supporting food items placed thereon.

3. The article display apparatus of claim 2 in which each of said first shelf members comprises:

a first annular flange;

an annular shelf portion extending radially outwardly from said first annular flange and having an outermost end formed with an annular hook, said annular shelf portion being tapered so that said outermost end is positioned vertically lower than said upper annular flange when assembled with said second shelf members of said article support assembly.

4. The article display apparatus of claim 3 in which each of said second shelf members comprises:

a second annular flange having an offset end formed to mate with said first annular flange of a first shelf member;

an annular support wall extending radially outwardly from said second annular flange and having an outermost end formed with a lip which mates with said annular hook of a first shelf member, whereby alternating first and second shelf members are interconnected together to form said article support assembly.

5. The article display apparatus of claim 1 in which said means for directing refrigerated air through said substantially sealed interior space of said article support assembly, comprises:

a vertically extending cooling column located within said sealed interior of said article support assembly, said cooling column having a wall defining a hollow interior, said wall being formed with inlet passages at the bottom end thereof and outlet passages at the top end thereof;

refrigeration means for directing refrigeration air into said sealed interior space of said article support assembly in a flow path wherein the refrigerated air flows into said interior of said cooling column to said top end thereof, out of said outlet passages in said top end into said sealed interior space of said article support assembly, into heat exchange relationship with respect to said food support means of said article support assembly and then into said hollow interior of said cooling column through said inlet openings at said bottom end thereof.

6. The article display apparatus of claim 5 in which said cooling column includes a baffle mounted to said outer wall thereof, said baffle extending radially outwardly from said outer wall of said cooling column downwardly toward said inlet passages therein to direct the flow of refrigerated air outwardly from said cooling column to said article support means located at said bottom end of said cooling column.

7. The article display apparatus of claim 1 in which said article support assembly has a top end and a bottom end, said housing having a sealing plate mounted in position to sealingly engage said top end of said article support assembly and said bottom end of said article support assembly being sealingly connected atop said article support carriage, whereby said sealed interior space of said article support assembly is enclosed at said top and bottom ends.

8. An article display apparatus for indirectly refrigerating food items and/or beverages, comprising:

a housing having a hollow interior;

an article support assembly carried within said hollow interior of said housing, said article support assembly having an interior which is substantially enclosed for substantially preventing the escape of refrigerated air therefrom and a wall including food support means for carrying articles of food and/or beverages outside of said enclosed interior and within said hollow interior of said housing;

a vertically extending cooling column located within said sealed interior of said article support assembly, said cooling column having a wall defining a hollow interior, said wall being formed with inlet passages at the bottom end thereof and outlet passages at the top end thereof; and refrigeration means for directing refrigerated air into said sealed interior space of said article support assembly in a flow path wherein the refrigerated air flows into said interior of said cooling column to said top end thereof, out of said outlet passages in said top and into said sealed interior space of said article support assembly, into heat exchange relationship with respect to said food support means of said article support assembly and then into said hollow interior of said cooling column through said inlet openings at said bottom end thereof to chill said article food support means so that said article food support means is effective for indirectly refrigerating articles of food and/or beverages carried thereon.

9. The article display apparatus of claim 8 in which said article support assembly comprises:

a number of alternating first shelf members and second shelf members interconnected to one another to form a substantially sealed interior;

one of said first and second shelf members being formed with a shelf portion for supporting food items placed thereon.

10. The article display apparatus of claim 8 in which said article support assembly comprises:

a beverage rack having a wall formed with means for supporting beverage containers vertically stacked end-to-end;

a shelf unit having a wall formed with means for supporting food items;

said beverage rack and said shelf unit being connected to one another so that said walls thereof form said enclosed interior which is substantially sealed.

11. An article display apparatus, comprising:

a base support;

a housing having an outer wall and a hollow interior, said housing being mounted to said base support;

door means mounted over an opening formed in said outer wall of said housing for permitting access into said interior of said housing;

an article support carriage mounted to said base support at the bottom of said housing;

an article support assembly mounted atop said article support carriage within said interior of said housing, said article support assembly including:

(i) a beverage rack having a wall formed with means for supporting beverage containers vertically stacked end-to-end;

(ii) a shelf unit having a wall formed with means for supporting food items;

(iii) said beverage rack and said shelf unit being connected to one another so that said walls thereof form an interior space which is substantially enclosed for substantially preventing the escape of refrigerated air therefrom;

means for directing refrigerated air through said enclosed interior space of said article support assembly so that the refrigerated air is brought into heat exchange relationship with respect to said wall of said beverage rack and said wall of said shelf unit, whereby said means for supporting beverage containers and said means for supporting food items become chilled by the refrigerated air and are effective to indirectly refrigerate the beverage containers and food items carried thereon.

12. The article display apparatus of claim 11 in which said beverage rack comprises a plurality of extrusions connected side-by-side to one another in a generally cylindrical shape, each of said extrusions being formed with a pair of columns having first and second gripping arms, said first and second gripping arms having opposed article gripping portions and opposed outer ends, the transverse dimension between said opposed article gripping portions being about equal to the transverse dimension of a beverage container to be held therebetween, the transverse dimension of said opposed outer ends being less than said transverse dimension of the beverage container so that said outer ends are spaced apart from an undeflected position upon insertion or removal of an article therebetween.

13. The article display apparatus of claim 11 in which one said beverage rack and said shelf unit is mounted to said article support carriage, and the other of said beverage rack and said shelf unit is mounted atop a mounting plate located therebetween.

14. The article display apparatus of claim 13 in which said housing includes a sealing plate mounted in position to sealingly engage said one of said beverage rack and shelf unit mounted atop said mounting plate, the other of said beverage rack and said shelf unit sealingly engaging said article support carriage.

15. The article display apparatus of claim 13 in which said shelf unit comprises:

a number of alternating first shelf members and second shelf members interconnected to one another to form said enclosed interior which is substantially sealed;

one of said first and second shelf members being formed with a shelf portion for supporting food items placed thereon.

16. The article display apparatus of claim 15 in which each of said first shelf members comprises:

a first annular flange;

an annular shelf portion extending radially outwardly from said first annular flange and having an outermost end formed with an annular hook, said annular shelf portion being tapered so that said outermost end is positioned vertically lower than said first annular flange when assembled with said second shelf members of said article support assembly.

17. The article display apparatus of claim 15 in which each of said second shelf members comprises:

a second annular flange having an offset end formed to mate with said first annular flange of a first shelf member;

an annular support wall extending radially outwardly from said second annular flange and having an outermost end formed with a lip which mates with said annular hook of a first shelf member, whereby alternating first and second shelf members are interconnected together to form said article support assembly.

18. The article display apparatus of claim 11 in which said means for directing refrigerated air through said enclosed interior space of said article support, comprises:

a vertically extending cooling column located within said enclosed interior of said article support assembly, said cooling column having a wall defining a hollow interior, said wall being formed with inlet passages at the bottom end thereof and outlet passages at the top end thereof;

refrigeration means for directing refrigerated air into said enclosed interior space of said article support assembly in a flow path wherein the refrigerated air flows into said hollow interior of said cooling column to said top end thereof, out of said outlet passages in said top end of said cooling column into said enclosed interior space of said article support assembly where the refrigerated air moves into heat exchange relationship with respect to said means for supporting beverage containers and said means for supporting food items, whereby said means for supporting beverage containers and said means for supporting food items are chilled by the refrigerated air and are effective to indirectly refrigerate beverage containers and food items carried thereon.

19. The article display apparatus of claim 18 in which said cooling column includes a baffle mounted to said outer wall thereof, said baffle extending radially outwardly from said outer wall of said cooling column downwardly toward said inlet passages therein to direct the flow of refrigerated air outwardly from said cooling column to one of said means for supporting food items and said means for supporting beverage containers at said bottom end thereof.

20. An article display apparatus, comprising:
a base support;
a housing having an outer wall and a hollow interior, said housing being mounted to said base support;
door means mounted over an opening formed in said outer wall of said housing for permitting access to said hollow interior of said housing;
an article support carriage mounted to said base support at the bottom of said housing;
an article support assembly mounted atop said article support carriage within said hollow interior of said housing, said article support assembly comprising a wall having an inner surface which defines an interior space and an outer wall which defines a displaying space between said wall and said outer wall of said housing, said outer surface of said wall including a plurality of food support means for carrying food and/or beverage items in said displaying space;
means for rotating said article support carriage when said door means is closed so that said article support assembly and said plurality of food support means are rotated simultaneously within said housing;
means for directing refrigerated air into said interior space of said article support assembly; and
means for substantially enclosing said interior space of said article support assembly for substantially preventing the escape of refrigerated air therefrom, so that when the refrigerated air is directed into said substantially enclosed interior space via said directing means, the refrigerated air is brought into heat exchange relationship with respect to at least a portion of the inner surface of said wall of said article food support assembly whereby said plurality of food support means of said article support assembly are chilled by the refrigerated air within said substantially enclosed interior space for indirectly refrigerating food and/or beverage items carried thereon in said displaying space.

21. An article display apparatus, comprising;
a base support;
a housing having an outer wall and a hollow interior, said housing being mounted to said base support;
door means mounted over an opening formed in said outer wall of said housing for permitting access to said hollow interior of said housing;
an article support carriage mounted to said base support at the bottom of said housing;
an article support assembly mounted atop said article support carriage within said hollow interior of said housing, said article support assembly comprising a wall having an inner surface which defines a substantially enclosed interior space for substantially preventing the escape of refrigerated air therefrom and an outer surface which defines a displaying space between said wall and said outer wall of said housing, said outer surface of said wall including food support means for carrying articles of food and/or beverages in said displaying space;
a number of alternating first shelf members and second shelf members interconnected to one another to form the substantially enclosed interior space, at least one said first and second shelf members being formed with a shelf portion for supporting food items placed thereon and each of said first shelf members comprising a first annular flange and an annular shelf portion extending radially outwardly from said first annular flange and having an outermost end formed with an annular hook, said annular shelf portion being tapered so that said outermost end is positioned vertically lower than said upper annular flange when assembled with said second shelf members of said article support assembly; and
means for directing refrigerated air into said substantially enclosed interior space of said article support assembly, so that the refrigerated air is brought into heat exchange relationship with respect to at least a portion of said inner surface of said wall of said article support assembly whereby said food support means of said article support assembly is chilled by the refrigerated air within said substantially enclosed interior space for indirectly refrigerating articles of food and/or beverages carried thereon in said displaying space.

22. The article display apparatus of claim 21, each of said second shelf members comprising:
a second annular flange having an offset end formed to mate with said first annular flange of one said first shelf member; and
an annular support wall extending radially outwardly from said second annular flange and having an outermost end formed with a lip which mates with said annular hook of one said first shelf member, whereby alternating said first and second shelf members are interconnected together to from said article support assembly.

23. An article display apparatus, comprising:
a base support;
a housing having an outer wall and a hollow interior, said housing being mounted to said base support;
door means mounted over an opening formed in said outer wall of said housing for permitting access to said hollow interior of said housing;
an article support carriage mounted to said base support at the bottom of said housing;
an article support assembly mounted atop said article support carriage within said hollow interior of said housing, said article support assembly comprising a wall having an inner surface which defines a substantially enclosed interior space for substantially preventing the escape of refrigerated air therefrom and an outer surface which defines a displaying space between said wall and said outer wall of said housing, said outer surface of said wall including food support means for carrying articles of food and/or beverages in said displaying space;
a vertically extending cooling column located within said sealed interior of said article support assembly, said cooling column having a wall defining a hollow interior, said wall being formed with inlet passages at the bottom end thereof and outlet passages at the top end thereof; and
refrigeration means for directing refrigerated air into said sealed interior space of said article support assembly in a flow path wherein the refrigerated air flows into said interior of said cooling column to said top end thereof, out of said outlet passages in said top end into said sealed interior space of said article support assembly, into heat exchange relationship with respect to said food support means of said article support assembly and then into said hollow interior of said cooling column through said inlet openings at said bottom end thereof, whereby said food support means of said article support assembly is chilled by the refrigerated air within said substantially enclosed interior space for indirectly refrigerating articles of food and/or beverages carried thereon.

24. The article display apparatus of claim 23 in which said cooling column includes a baffle mounted to said outer wall thereof, said baffle extending radially outwardly from said outer wall of said cooling column downwardly toward said inlet passages therein to direct the flow of refrigerated air outwardly from said cooling column to said article support means located at said bottom end of said cooling column.

25. An article display apparatus, comprising:

a base support;

a housing having an outer wall and a hollow interior, said housing being mounted to said base support;

door means mounted over an opening formed in said outer wall of said housing for permitting access to said hollow interior of said housing;

an article support carriage mounted to said base support at the bottom of said housing;

an article support assembly mounted atop said article support carriage within said hollow interior of said housing, said article support assembly comprising a wall having an inner surface which defines a substantially enclosed interior space for substantially preventing the escape of refrigerated air therefrom and an outer surface which defines a displaying space between said wall and said outer wall of said housing, said outer surface of said wall including food support means for carrying articles of food and/or beverages in said displaying space;

said article support assembly having a top end and a bottom end, said housing having a sealing plate mounted in position to sealingly engage said top end of said article support assembly and said bottom end of said article support assembly being sealingly connected atop said article support carriage, whereby said sealed interior space of said article support assembly is enclosed at said top and bottom ends; and means for directing refrigerated air into said substantially enclosed interior space of said article support assembly, so that the refrigerated air is brought into heat exchange relationship with respect to at least a portion of said inner surface of said wall of said article support assembly whereby said food means of said article support assembly is chilled by the refrigerated air within said substantially enclosed interior space for indirectly refrigerating articles of food and/or beverages carried thereon in said displaying space.

26. An article display apparatus for indirectly refrigerating food items and/or beverages, comprising:

a housing having a hollow interior;

an article support assembly carried within said hollow interior of said housing, said article support assembly having an interior which is substantially enclosed for substantially preventing the escape of refrigerated air therefrom and a wall including food support means for carrying articles of food and/or beverages outside of said enclosed interior and within said hollow interior of said housing;

said article support assembly comprising a beverage rack having a wall formed with means for supporting beverage containers vertically stacked end-to-end, a shelf unit having a wall formed with means for supporting food items, and said beverage rack and said shelf unit being connected to one another so that said walls thereof form said enclosed interior which is substantially sealed; and means for refrigerating said enclosed interior of said article support assembly to chill said article food support means so that said article support means is effective for indirectly refrigerating articles of food and/or beverages carried thereon.

* * * * *

UNITED STATES PATENT AND TRADEMARK OFFICE

CERTIFICATE OF CORRECTION

PATENT NO. : 5,058,393

DATED : October 22, 1991

INVENTOR(S) : Floyd R. Callon and Harvey W. Benison

It is certified that error appears in the above-identified patent and that said Letters Patent is hereby corrected as shown below:

Column 11, line 48, after "seal" insert --111--.

Column 14, line 14, after "seal" insert --111--.

Column 16, line 31, change "ar" to --are--.

Column 17, line 16, after "means for" change "supporting" to --directing--.

Column 18, line 1, after "directing" change "refrigeration" to --refrigerated--.

Column 22, line 29, after "together to" change "from" to --form--.

Signed and Sealed this

Thirtieth Day of March, 1993

*Attest:*

*Attesting Officer*

STEPHEN G. KUNIN

*Acting Commissioner of Patents and Trademarks*